US007823882B2

(12) United States Patent
Sato

(10) Patent No.: US 7,823,882 B2
(45) Date of Patent: Nov. 2, 2010

(54) TRANSPORT APPARATUS

(75) Inventor: Fuminori Sato, Noda (JP)

(73) Assignee: Komori Corporation, Tokyo (JP)

( * ) Notice: Subject to any disclaimer, the term of this patent is extended or adjusted under 35 U.S.C. 154(b) by 3 days.

(21) Appl. No.: 12/428,159

(22) Filed: Apr. 22, 2009

(65) Prior Publication Data

US 2009/0267289 A1 Oct. 29, 2009

(30) Foreign Application Priority Data

Apr. 23, 2008 (JP) ..... 2008-112127

(51) Int. Cl.
*B65H 29/20* (2006.01)

(52) U.S. Cl. ..... 271/315

(58) Field of Classification Search ..... 271/315, 271/187, 9.01

See application file for complete search history.

(56) References Cited

U.S. PATENT DOCUMENTS

2001/0042958 A1* 11/2001 Kishine et al. ..... 271/315
2005/0242498 A1* 11/2005 Sato ..... 271/302

FOREIGN PATENT DOCUMENTS

JP 3-249056 * 11/1991
JP 2005-145629 A 6/2005

* cited by examiner

*Primary Examiner*—David H Bollinger
(74) *Attorney, Agent, or Firm*—Birch, Stewart, Kolasch & Birch LLP

(57) ABSTRACT

A transport apparatus, including a first transport portion for transporting one signature, a second transport portion for transporting other signature, and a fan wheel for entering both sheets, which have been transported by the first and second transport portions, between vanes thereof, and rotationally transporting the sheets, comprises: a main frame for supporting the first transport portion and the fan wheel; a movable frame for supporting the second transport portion; a first adjusting device for moving the main frame and the movable frame by the same amount; and a second adjusting device for moving the movable frame relative to the main frame.

8 Claims, 5 Drawing Sheets

TRANSPORT APPARATUS

TECHNICAL FIELD

This invention relates to a transport apparatus for transporting a sheet. More particularly, the invention relates to a transport apparatus effective when applied to transporting a signature printed by a printing press and folded by a folder.

BACKGROUND ART

When signatures printed by a printing press and folded by a plurality of folders are piled at one location and delivered, it is common practice to transport a signature folded by one of the folders and a signature folded by the other folder toward a fan wheel provided in the one folder by one of transport belts and the other transport belt running as a pair, alternately feed the signature folded by the one folder and the signature folded by the other folder to the fan wheel, and discharge the signatures in alignment to a delivery device disposed below the fan wheel.

In such a transport apparatus, a paper jam or the like may occur in the surroundings of the fan wheel. As an example of an apparatus which can facilitate the operation of removing the jammed signature from such a jamming state, there can be named a transport apparatus as described in Patent Literature 1.

In the Patent Literature 1, a roller for supporting one of transport belts, a chopper device, and a fan wheel are supported by one of frames in one of the folders. The one frame is provided with one of adjusting mechanisms, and the one adjusting mechanism adjusts the position in the right-and-left direction of the one frame.

In the other folder, the other transport belt is passed over a first roller, a second roller, a third roller, and a fourth roller. The first roller is disposed nearest the fan wheel in the one folder. The second roller is adjacent to the first roller downstream in the travel direction of the transport belt, and is disposed at a retreat position spaced from the neighborhood of the fan wheel. The third roller is adjacent to the first roller upstream in the travel direction of the transport belt, and is located between the first roller and the second roller. The fourth roller is adjacent to the second roller downstream in the travel direction of the transport belt, and is located between the second roller and the third roller. The first roller and the second roller are supported by a moving frame, while the third roller and the fourth roller are supported by the other frame.

In such a transport apparatus, during maintenance, for example, one for a paper jam of the signature transported by the one transport belt, there is a space downstream, in the rotating direction of the fan wheel, of a path for the entry of the signature to the fan wheel. The jammed signature can be removed in this space. That is, the work of removing the jammed signature can be performed, without moving the one transport belt with respect to the fan wheel.

In the case of maintenance, for example, one for a paper jam of the signature transported by the other transport belt, on the other hand, the one transport belt is passed over a site downstream, in the rotating direction of the fan wheel, of the path for the entry of the signature to the fan wheel. This jammed signature cannot be removed at the downstream site. This requires that the other transport belt be moved with respect to the fan wheel. Thus, the moving frame has to be rendered movable with respect to the one frame. For this reason, the moving frame is provided with the other adjusting mechanism. The other adjusting mechanism adjusts the position in the right-and-left direction of the moving frame, concretely, the position between the position close to the fan wheel in the one folder and the retreat position spaced from this position close to the fan wheel.

Since the above-described configuration has to be adopted, two operations, i.e., an operation for the one adjusting mechanism and an operation for the other adjusting mechanism, are performed when adjusting the position of folding of the signature by the chopper device. Concretely, when the one frame for supporting the chopper device is moved by the one adjusting mechanism, the one transport belt and the fan wheel supported by the one frame are moved in accordance with this movement, but the other transport belt is not moved. Thus, the moving frame is moved by the other adjusting mechanism to adjust the other transport belt to an appropriate position with respect to the path of entry of the signature to the fan wheel.

SUMMARY OF INVENTION

Technical Problem

In the transport apparatus described in the above-described Patent Literature 1, maintenance such as one for a paper jam can be performed, and the position of signature folding by the chopper device can be adjusted. In adjusting the position of signature folding by the chopper device, however, both of the one adjusting mechanism and the other adjusting mechanism have to be operated, thus requiring an excessive time for aligning the other transport belt with an appropriate position with respect to the path of entry of the signature to the fan wheel. That is, the problems of a decrease in productivity and a heavy working load on an operator have been posed.

The present invention has been proposed in the light of the above-mentioned problems. It is an object of this invention to provide a transport apparatus which can effectively achieve an increase in productivity and a reduction in the working load on the operator.

Solution to Problem

A transport apparatus according to a first aspect of the present invention for solving the above problems is a transport apparatus, including a first transport portion for transporting one sheet, a second transport portion for transporting other sheet, and a fan wheel for entering both of the sheets, which have been transported by the first transport portion and the second transport portion, between vanes of the fan wheel, and rotationally transporting the sheets, the transport apparatus comprising: a first support member for supporting the first transport portion and the fan wheel; a second support member for supporting the second transport portion; first adjusting means for moving the first support member and the second support member by an equal amount; and second adjusting means for moving the second support member relative to the first support member.

A transport apparatus according to a second aspect of the present invention for solving the above problems is the transport apparatus according to the first aspect, wherein the first adjusting means has a connecting member for connecting the first support member and the second support member together.

A transport apparatus according to a third aspect of the present invention for solving the above problems is the transport apparatus according to the second aspect, wherein the second adjusting means comprises a drive motor, a threaded shaft rotating upon driving of the drive motor, and a moving member screwed to a threaded portion of the threaded shaft and fixed to the second support member, and the connecting member is a thrust bearing for connecting the first support member and the threaded shaft together so that the threaded shaft is rotatable and axially immovable with respect to the first support member.

A transport apparatus according to a fourth aspect of the present invention for solving the above problems is the transport apparatus according to the second aspect, wherein the first adjusting means has a screw screwed to the first support member and moving the first support member.

A transport apparatus according to a fifth aspect of the present invention for solving the above problems is the transport apparatus according to the second aspect, wherein the second adjusting means comprises a drive motor having a first gear on an output shaft thereof, a threaded shaft having a second gear meshing with the first gear and rotating upon driving of the drive motor, and a moving member screwed to a threaded portion of the threaded shaft and fixed to the second support member, and when the first support member, the connecting member, the threaded shaft, the moving member, and the second support member are moved by the first adjusting means, mesh between the first gear and the second gear is not released.

A transport apparatus according to a sixth aspect of the present invention for solving the above problems is the transport apparatus according to the first aspect, wherein the first adjusting means moves the first support member so that a folding position of the one sheet transported by the first transport portion and folded by a chopper device changes, and also moves the second support member so that a supply position of the other sheet transported by the second transport portion and supplied to the fan wheel does not change according to the movement of the first support member.

A transport apparatus according to a seventh aspect of the present invention for solving the above problems is the transport apparatus according to the first aspect, wherein the second adjusting means moves the second support member so that the second transport portion moves between a supply position where the other sheet transported by the second transport portion is supplied to the fan wheel, and a retreat position retreated from the supply position.

A transport apparatus according to an eighth aspect of the present invention for solving the above problems is the transport apparatus according to the fourth aspect, further comprising an operating portion for operating the screw to turn in a forward or reverse direction.

Advantageous Effects of Invention

According to the transport apparatus of the present invention, the first adjusting means can move the first transport portion, the fan wheel and the second transport portion by the same amount, while the second adjusting means can move the second transport portion relative to the first transport portion and the fan wheel. Because of these features, the first transport portion, the fan wheel, and the second transport portion need not be adjusted individually, so that the working time can be shortened, and the work itself can be lightened. As a result, productivity can be increased, and a reduction in the working load on the operator can be achieved effectively.

DESCRIPTION OF EMBODIMENTS

The best mode of the transport apparatus according to the present invention will be described concretely by embodiments.

First Embodiment

A first embodiment of the transport apparatus according to the present invention is an application to an apparatus in which signatures printed by a printing press and folded by two folders are piled at one location and delivered.

The first embodiment of the transport apparatus according to the present invention will now be described with reference to FIGS. 1 to 5.

Figure 1:
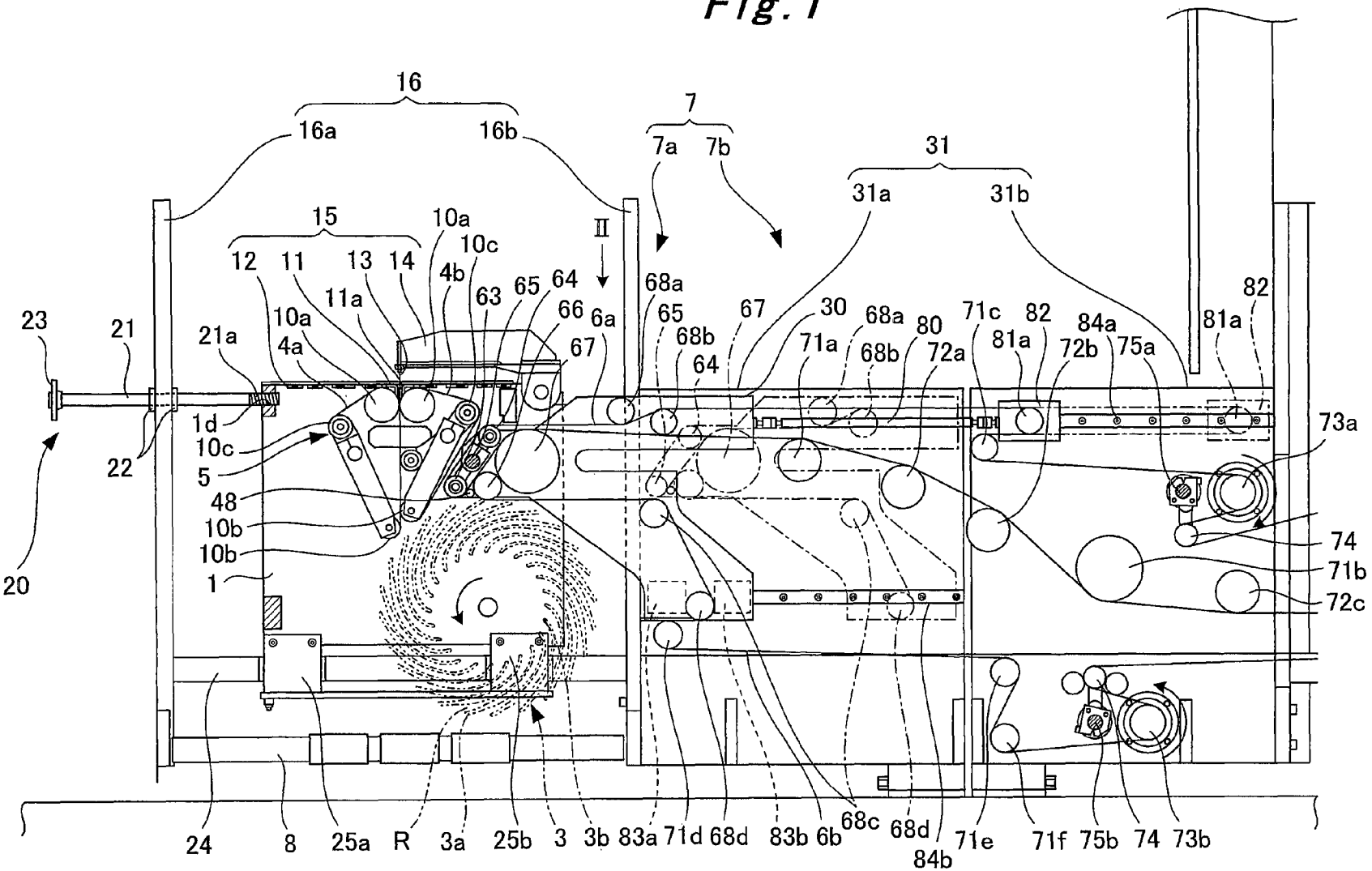
FIG. 1 is a schematic configurational drawing of a transport apparatus according to a first embodiment of the present invention.
Figure 2:
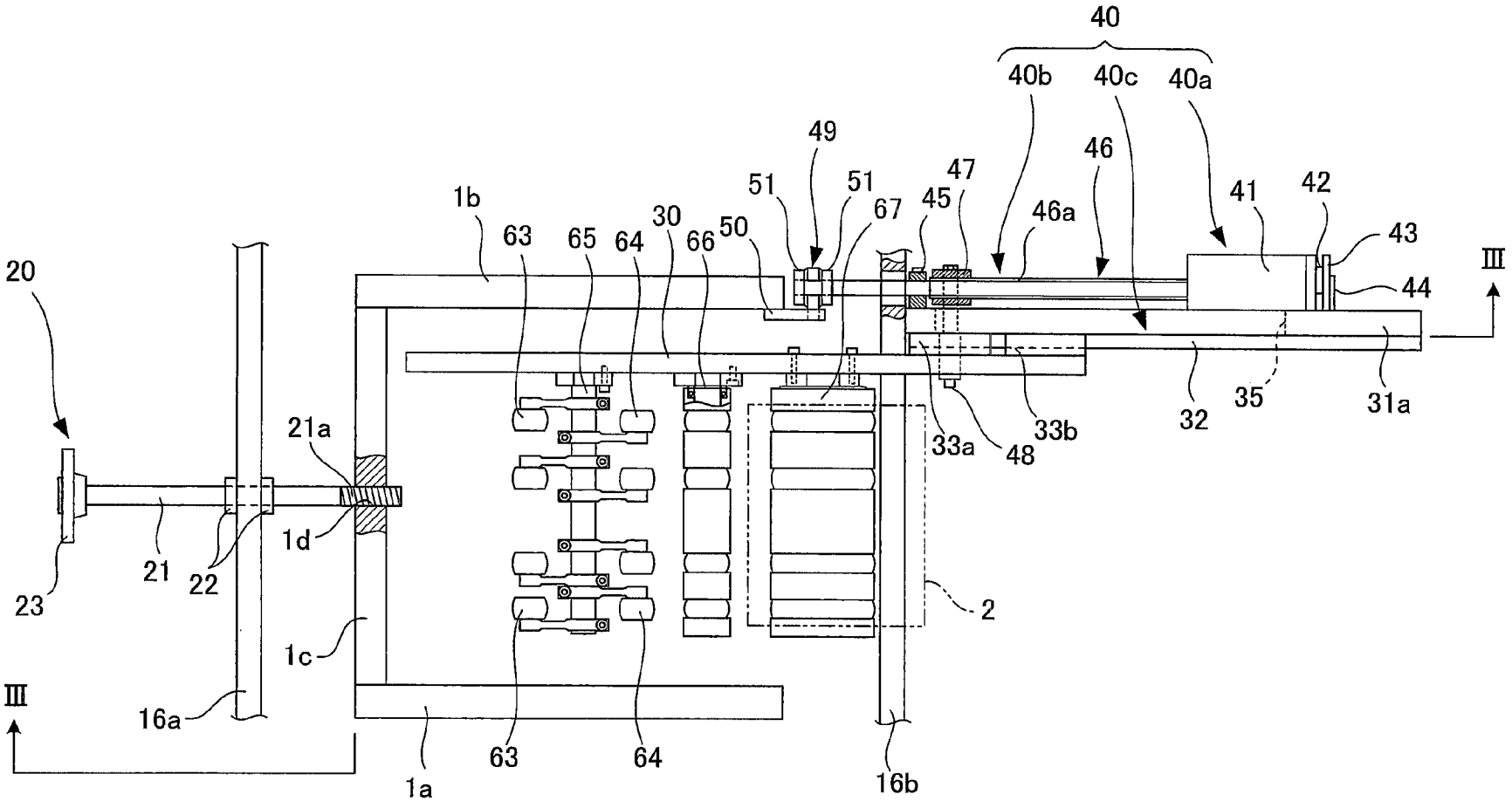
FIG. 2 is a view taken from the direction of an arrowed line II in FIG. 1.
Figure 3:
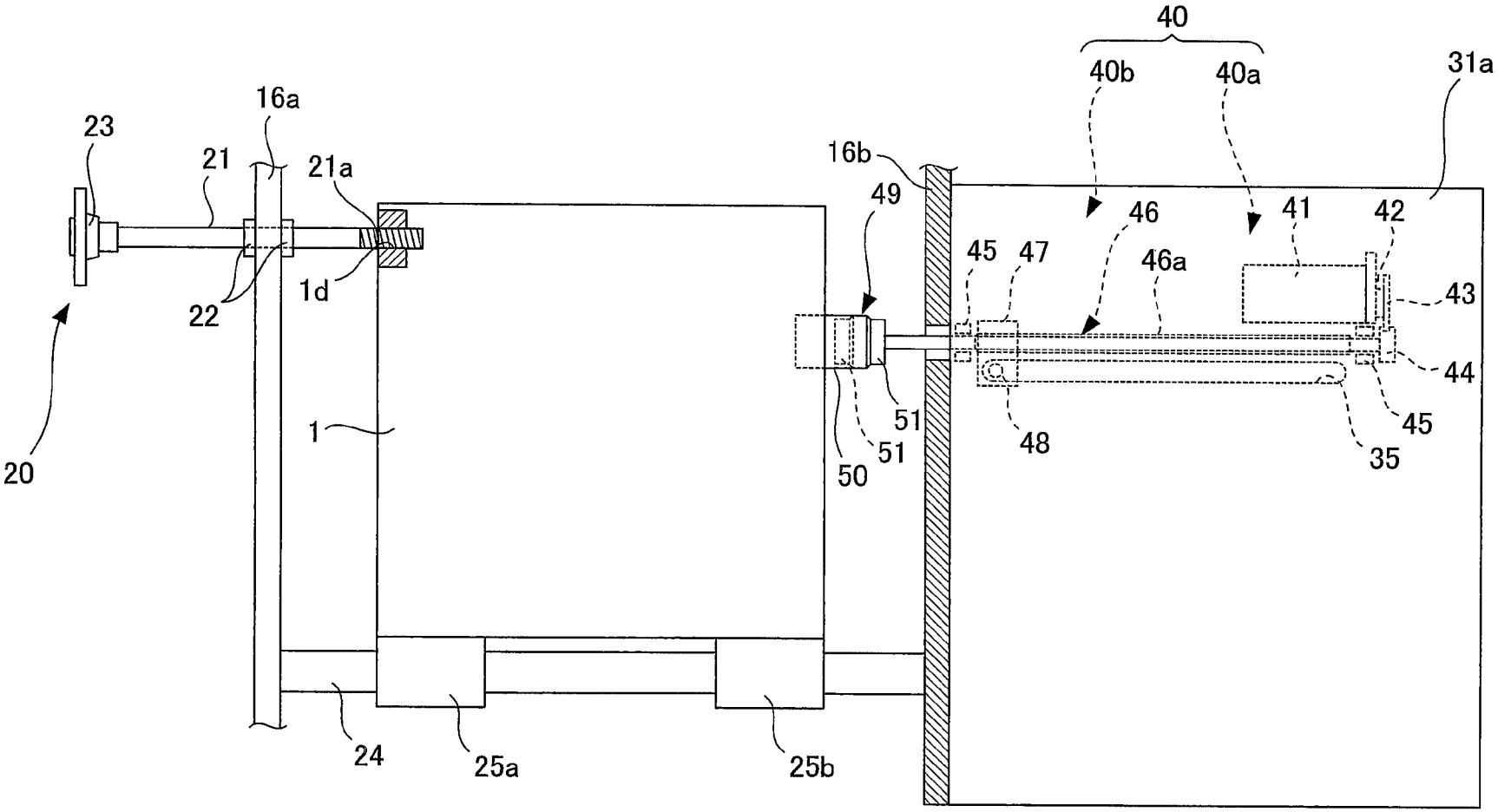
FIG. 3 is a view taken from the direction of an arrowed line III in FIG. 2.
Figure 4:
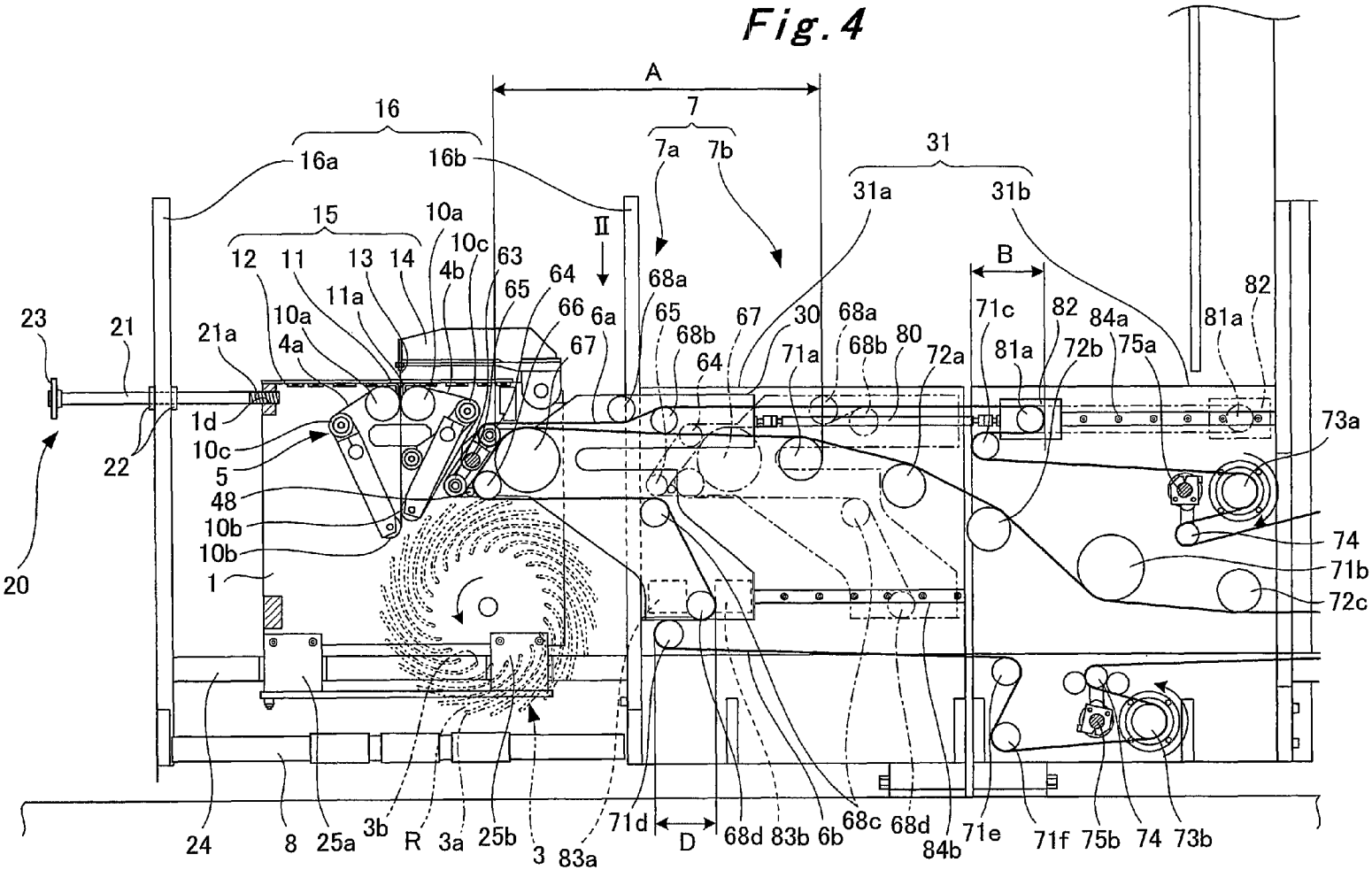
FIG. 4 is a view for illustrating a case in which a second transport portion provided in the transport apparatus according to the first embodiment of the present invention is disposed at a signature supply position.
Figure 5:
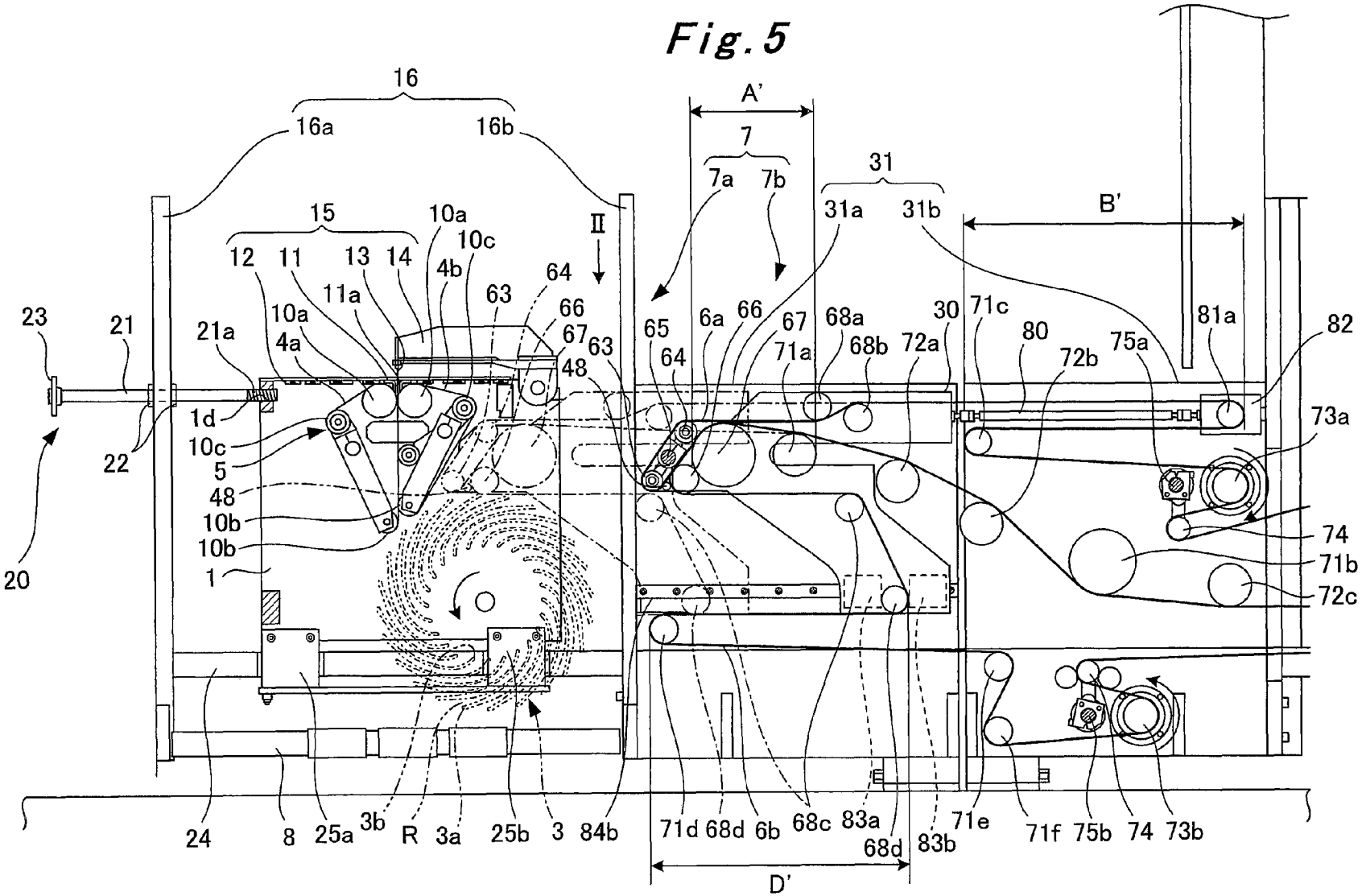
FIG. 5 is a view for illustrating a case in which the second transport portion provided in the transport apparatus according to the first embodiment of the present invention is disposed at a retreat position.

FIG. 1 is a schematic configurational drawing of the transport apparatus. FIG. 2 is a view taken from the direction of an arrowed line II in FIG. 1. FIG. 3 is a view taken from the direction of an arrowed line III in FIG. 2. FIG. 4 is a view for illustrating a case in which a second transport portion of the transport apparatus is disposed at a signature supply position. FIG. 5 is a view for illustrating a case in which the second transport portion of the transport apparatus is disposed at a retreat position. In FIGS. 1 and 4, a case where a movable frame is disposed at the signature supply position is indicated by solid lines, while a case where the movable frame is disposed at the retreat position is indicated by dashed dotted lines. In FIG. 5, a case where the movable frame is disposed at the retreat position is indicated by solid lines, while a case where the movable frame is disposed at the signature supply position is indicated by dashed dotted lines.

The transport apparatus according to the present embodiment, as shown in FIG. 1, comprises a first transport portion 5 for transporting one of signatures (not shown) as a first sheet folded by a first chopper folding device (one of chopper folding devices) 15 as one of folders, and a second transport portion 7 for transporting the other signature 2 (see FIG. 2) as a second sheet folded by a second chopper folding device (the other chopper folding device; not shown) as the other folder. Both signatures transported by the first and second transport portions 5 and 7 are alternately entered into an entry path R between vanes 3*a* of a fan wheel 3, and rotationally transported. A single delivery conveyor 8 is disposed below the fan wheel 3, and the signatures rotationally transported by the fan wheel 3 are sequentially delivered onto the delivery conveyor 8. The numeral 3*b* denotes a grooved portion of the fan wheel 3.

In the first transport portion 5, the one signature is transported while being held between right and left paired belts 4*a* and 4*b*. The right and left paired belts 4*a* and 4*b* are passed over right and left paired let-off rollers 10*a*, 10*b*, 10*c*. Above the first transport portion 5, the first chopper folding device 15 is disposed to be located above the let-off rollers 10*a* among the right and left paired let-off rollers 10*a*, 10*b*, 10*c*.

The first chopper folding device 15 (chopper device) comprises a chopper table 11, a plurality of transport belts 12, and a chopper arm 14. The right and left paired let-off rollers 10*a*, 10*b*, 10*c*, the first chopper folding device 15, and the fan wheel 3 are supported by a main frame (first support member) 1.

The chopper table 11 is located above the let-off rollers 10*a*, and has a tuck-in groove 11*a*. The plurality of transport belts 12 travel on the chopper table 11, thereby transporting the one signature. The chopper arm 14 is equipped with a chopper blade portion (blade) 13 having a leading end part fitted into the tuck-in groove 11*a*. The belts 4*a*, 4*b* are each tape-shaped, and are arranged in plural numbers with predetermined spacing in the width direction of the one signature.

The main frame 1, as shown in FIGS. 1 and 2, is disposed within a fixed frame 16 having right and left paired fixed frames 16*a* and 16*b* in the drawings. As shown in FIG. 2, the main frame 1 is in a U-shape opening rightward in the drawing when viewed in a horizontal section. The main frame 1 has a pair of frames 1*a* and 1*b*, and a connecting frame 1*c* connected to one end side of each of the pair of frames 1*a* and 1*b*, thereby coupling these frames 1*a* and 1*b* together.

In the second transport portion 7, the other signature is transported while being held between upper and lower paired belts 6*a* and 6*b*. The second transport portion 7 is supported by a movable frame (second support member) 30, and right and left paired sub-frames 31.

The belts 6*a*, 6*b* are each tape-shaped, and are arranged in plural numbers with predetermined spacing in the width direction of the other signature 2.

The above-described transport apparatus is further equipped with a first adjusting device (first adjusting means) 20 for moving the main frame 1 and the movable frame 30 by the same amount, and a second adjusting device (second adjusting means) 40 for moving the movable frame 30 relative to the main frame 1. The transport apparatus is supported by having a thrust bearing (connecting member) 49 interposed between the main frame 1 and the movable frame 30, the thrust bearing 49 being coupled to the main frame 1 and the movable frame 30 rotatably and axially immovably.

In the second transport portion 7, a signature supply portion 7*a*, which is a downstream side of the upper and lower paired belts 6*a* and 6*b* in the signature transport direction (i.e., a left half part in FIG. 1), is located between the pair of frames 1*a* and 1*b*, and is passed over and supported by the movable frame 30, as shown in FIGS. 1 and 2. A signature transport portion 7*b*, which is the other half part of the upper and lower paired belts 6*a* and 6*b* (i.e., a right half part in FIG. 1), is located between the right and left paired sub-frames 31 (one of the sub-frames is not shown) connected to one of the frames, 1*b*, and is passed thereover and supported thereby. The sub-frame 31 has a first sub-frame 31*a* disposed in proximity to the fan wheel 3, and a second sub-frame 31*b* disposed on an upstream side, in the travel direction of the signature 2, of the second transport portion 7.

On the first sub-frame 31*a*, the second adjusting device 40 for moving the movable frame 30 relative to the frames 1*a*, 1*b* is disposed, as shown in FIGS. 2 and 3. The second adjusting device 40 has a power source 40*a*, a power transmitting portion 40*b* for transmitting power and allowing the power to act, and a guide portion 40*c* for moving the movable frame 30 by the transmitted power. The power source 40*a* is a drive motor 41 fixed to the first sub-frame 31*a*. The drive motor 41 has a rotatable output shaft 42, and a first gear 43 fixed to the leading end of the output shaft 42.

The power transmitting portion 40*b* has a threaded shaft 46, which has fixed to one end part thereof a second gear 44 wider than the first gear 43 and engaging the first gear 43, and which has in the other end part thereof a pair of disk-shaped engaging members 51, the threaded shaft 46 being rotatably supported via a pair of bearings 45 located between the one end part and the other end part and fixed to the first sub-frame 31*a*. The threaded shaft 46 extends in a horizontal direction along the first sub-frame 31*a*, has at the leading end thereof the pair of engaging members 51 engaging the thrust bearing 49. The thrust bearing 49 is supported rotatably and axially immovably by the other end side of the one frame 1*b* via a fitting 50. That is, the thrust bearing 49 connects the frame 1*b* and the threaded shaft 46 so that the threaded shaft 46 is rotatable and axially immovable with respect to the frame 1*b*. On the threaded shaft 46, a moving member 47 is disposed to be screwed to a threaded portion 46*a* formed on the circumferential surface of the threaded shaft 46. The moving member 47 is fixed to the movable frame 30 via a connecting pin 48 disposed to penetrate the moving member 47, the first sub-frame 31*a*, and the movable frame 30. However, the connecting pin 48 is disposed through a slot 35 which is formed in the first sub-frame 31*a* and which has a major diameter extending in the same direction as the threaded shaft 46.

The guide portion 40*c* has a movable frame linear guide 32 provided inwardly of the first sub-frame 31*a* and extending in the same direction as the threaded shaft 46 and the slot 35, and slide portions 33*a*, 33*b* provided on the proximal end side of the movable frame 30 and slidable along the movable frame linear guide 32.

The proximal end side of a shaft 65, which supports four front rollers 63 and four rear rollers 64 for belt support, is fixed to the movable frame 30, as shown in FIGS. 1 and 2. A pressing roller 66 for pressing the belts 6*a*, 6*b*, and a driven roller 67 are fixed to the movable frame 30. Further, four driven rollers 68*a* to 68*d* for belt support are fixed to the movable frame 30.

Six driven rollers 71*a* to 71*f* for belt support are fixed to the first and second sub-frames 31*a* and 31*b*, and three pressing rollers 72*a* to 72*c* for pressing the belts 6*a*, 6*b* are also fixed the first and second sub-frames 31*a* and 31*b*, as shown in FIG. 1. Two drive rollers 73*a* and 73*b* for belt support, and two shafts 75*a* and 75*b* for supporting belt support tension rollers 74 paired with the drive rollers 73*a*, 73*b* are fixed to the second sub-frame 31*b*.

As shown in FIG. 1, a shaft 80 is fixed to a proximal end part in an upper part of the movable frame 30 (i.e., a side part on the other folder side). An upper support block 82 for supporting a belt support driven roller 81*a* rotatably is fixed to the leading end of the shaft 80. Linear guides 84*a*, 84*b* located at upper and lower positions and extending in the right-and-left direction are disposed on the second and first sub-frames 31*b* and 31*a*. The upper support block 82 is disposed to be movable along the upper linear guide 84*a*. Lower support blocks 83*a*, 83*b* are fixed to a lower part of the movable frame 30, and the lower support blocks 83*a*, 83*b* are disposed to be movable along the lower linear guide 84*b*.

The first adjusting device 20 has the aforementioned thrust bearing 49, and a rotatable shaft body (screw) 21 which is disposed to have a threaded portion 21*a* screwed to a tapped hole 1*d* of the connecting frame 1*c* on the upper side of the main frame 1, as shown in FIG. 2. The shaft body 21 extends linearly. A movement restraining member 22 is fixed to the shaft body 21 in such a manner as to be located on both sides of the left-hand fixed frame 16*a* on the shaft body 21. By so doing, the bilateral movement of the shaft body 21 is restrained with respect to the left-hand fixed frame 16*a*. A handle 23 (operating portion) is mounted on the proximal end side of the shaft body 21.

A guide rail 24 extending between the right and left paired fixed frames 16*a* and 16*b* is disposed in a lower part of the main frame 1, as shown in FIGS. 1 and 3. Right and left paired engaging portions 25*a* and 25*b* movable along the guide rail 24 are mounted on the lower part of the main frame 1. Thus, when the handle 23 is rotated (rotationally operated), the threaded portion 21*a* of the shaft body 21 acts on the tapped hole 1*d* of the main frame 1, thereby moving the main frame 1 rightward or leftward along the guide rail 24.

A second chopper folding device of the same configuration as the first chopper folding device 15, for feeding the other signature 2 to the second transport portion 7, is disposed at an arbitrary position outside of the drawing.

The upper belt 6*a* of the second transport portion 7, in FIG. 1, is passed over the respective rollers counterclockwise based on the drive roller 73*a* in the following sequence: driven roller 71*c*→driven roller 81*a*→driven roller 68*b*→driven roller 68*a*→roller 64→roller 63→pressing roller 66→driven roller 67→driven roller 71*a*→pressing roller 72*a*→pressing roller 72*b*→driven roller 71*b*→pressing roller 72*c*→roller 74 supported by shaft 75*a*.

On the other hand, the lower belt 6*b* of the second transport portion 7, in FIG. 1, is passed over the respective rollers clockwise based on the drive roller 73*b* in the following sequence: driven roller 71*f*→driven roller 71*e*→driven roller 71*d*→driven roller 68*d*→driven roller 68*c*→pressing roller 66→driven roller 67→driven roller 71*a*→pressing roller 72*a*→pressing roller 72*b*→driven roller 71*b*→pressing roller 72*c*→roller 74 supported by shaft 75*b*.

In the transport apparatus composed of the first adjusting device 20 and the second adjusting device 40 described above, the output shaft 42 of the drive motor 41 is rotationally driven, and the first gear 43 fixed to the output shaft 42 is rotated, during routine operation. In accordance with this rotation, the second gear 44 meshing with the first gear 43 also rotates, with the result that the threaded shaft 46 having the second gear 44 fixed thereto also rotates. This rotation of the threaded shaft 46 acts on the moving member 47 disposed to be screwed to the threaded portion 46*a* of the threaded shaft 46, whereby the moving member 47 is brought to the left end of the threaded portion 46*a*. On this occasion, the force acting on the moving member 47 acts on the movable frame 30 via the connecting pin 48. As a result, the movable frame 30 moves along the movable frame linear guide 32, and is brought to its left end. That is, the movable frame 30 is located at a signature supply position (near the fan wheel 3) where the supply of the signature 2 to the fan wheel 3 is possible, as indicated by solid lines in FIGS. 1 and 4.

Thus, the one signature from the first transport portion 5 equipped with the right and left paired belts 4*a* and 4*b* (i.e., the one signature chopper-folded by the first chopper folding device 15), and the other signature 2 from the second transport portion 7 equipped with the upper and lower paired belts 6*a* and 6*b* (i.e., the other signature chopper-folded by the second chopper folding device outside the drawing) are alternately inserted (merged) between the adjacent vanes 3*a* of the fan wheel 3, and sequentially delivered onto the delivery conveyor 8 disposed below.

During maintenance, such as one for a paper jam in the signature supply portion 7*a*, belt replacement, or the position adjustment of the rollers or the various rollers, the output shaft 42 of the drive motor 41 is rotationally driven in a stopped state of the machine, as during the aforementioned routine operation, whereby the threaded shaft 46 is also rotated via the first gear 43 and the second gear 44. In accordance with this rotation of the threaded shaft 46, the moving member 47 disposed to be screwed to the threaded portion 46*a* of the threaded shaft 46 is acted on, and brought to the right end of the threaded portion 46*a*. On this occasion, the force acting on the moving member 47 acts on the movable frame 30 via the connecting pin 48. As a result, the movable frame 30 moves along the movable frame linear guide 32, and is brought to its right end. That is, the movable frame 30 is separated from the neighborhood of the fan wheel 3, and located at a retreat position where the supply of the signature 2 to the fan wheel 3 is impossible, as indicated by dashed dotted lines in FIG. 1 and solid lines in FIG. 5. At this time, the upper belt 6*a* has its length between the driven roller 67 and the driven roller 71*a* decreased in comparison with the case of routine operation, but has its length between the driven roller 71*c* and the driven roller 81*a* increased by the decreased length, so that the occurrence of looseness associated with the movement of the movable frame 30 is suppressed. On the other hand, the lower belt 6*b* has its length between the driven roller 67 and the driven roller 71*a* decreased in comparison with the case of routine operation, but has its length between the driven roller 68*d* and the driven roller 71*d* increased by the decreased length, so that the occurrence of looseness associated with the movement of the movable frame 30 is suppressed.

Concretely, with the upper transport belt 6*a*, when the movable frame 30 is located at the signature supply position, the spacing between the driven roller 67 and the driven roller 71*a* becomes a distance A, and the spacing between the driven roller 81*a* and the driven roller 71*c* becomes a distance B, as shown in FIG. 4. When the movable frame 30 is located at the retreat position, on the other hand, the spacing between the driven roller 67 and the driven roller 71*a* becomes a distance A', and the spacing between the driven roller 81*a* and the driven roller 71*c* becomes a distance B', as shown in FIG. 5. Since the sum of the distance A and the distance A' equals the sum of the distance B and the distance B', the looseness of the upper transport belt 6*a* is prevented.

Concretely, with the lower transport belt 6*b*, when the movable frame 30 is located at the signature supply position, the spacing between the driven roller 67 and the driven roller 71*a* becomes a distance A, and the spacing between the driven roller 71*d* and the driven roller 68*d* becomes a distance D, as shown in FIG. 4. When the movable frame 30 is located at the retreat position, on the other hand, the spacing between the driven roller 67 and the driven roller 71*a* becomes a distance A', and the spacing between the driven roller 71*d* and the driven roller 68*d* becomes a distance D', as shown in FIG. 5. Since the sum of the distance A and the distance A' equals the sum of the distance D and the distance D', the looseness of the lower transport belt 6*b* is prevented.

That is, the second adjusting device 40 moves the movable frame 30 so that the second transport portion 7 moves between the signature supply position where the other signature 2 transported by the second transport portion 7 is supplied to the fan wheel 3, and the retreat position retreated from the signature supply position.

Further, when the positions of the respective devices fixed to the main frame 1 (i.e., the fan wheel 3, the first transport portion 5, the first chopper folding device 15, etc.) are to be adjusted, for example, when the position of chopper folding of the sheet by the first chopper folding device 15 on the side of the first transport portion 5 is to be adjusted, the following operation is performed: The handle 23 is rotated to allow the threaded portion 21*a* of the shaft body 21 to act on the tapped hole 1*d* of the main frame 1, whereby the engaging portions 25*a*, 25*b* fixed to the lower part of the main frame 1 move along the guide rail 24. The first chopper folding device 15 fixed to the main frame 1 also moves, thereby adjusting the position of the tuck-in groove 11*a* of the chopper table 11.

Even when such position adjustment of the chopper folding device 15 is made, the other devices on the side of the first transport portion 5, for example, the right and left paired belts 4*a* and 4*b*, the fan wheel 3, etc. are fixed to the main frame 1, so that the positions of these devices are retained. Further, the main frame 1 is connected to the movable frame 30 via the fitting 50, the thrust bearing 49, the threaded shaft 46, the moving member 47, and the connecting pin 48, and thus, the movable frame 30 moves in accordance with the movement of the main frame 1. Accordingly, the signature supply portion 7*a* in the second transport portion 7 fixed to the movable frame 30 also moves together with the main frame 1, whereupon the positions of the signature supply portion 7*a* and the fan wheel 3 relative to each other are retained. In other words, the first adjusting device 20 moves the main frame 1 so as to change the folding position of the one signature which is transported by the first transport portion 5 and folded by the first chopper folding device 15, and also moves the movable frame 30 so as not to change the supply position of the other signature 2 which is transported by the second transport portion 7 in accordance with the movement of the main frame 1 and supplied to the fan wheel 3.

The transport apparatus according to the first embodiment of the present invention, as described above, has the main frame 1 for supporting the first transport portion 5 and the fan wheel 3, the movable frame 30 for supporting the second transport portion 7, the first adjusting device 20 for moving the main frame 1 and the movable frame 30 by the same amount, and the second adjusting device 40 for moving the movable frame 30 relative to the main frame 1. Thus, the transport apparatus can move the first transport portion 5, the fan wheel 3 and the second transport portion 7 by the same amount, and can move the second transport portion 7 relative to the first transport portion 5 and the fan wheel 3. Because of these features, the first transport portion 5, the fan wheel 3, and the second transport portion 7 need not be adjusted individually, so that the working time can be shortened, and the work itself can be lightened. As a result, productivity can be increased, and a reduction in the working load on the operator can be achieved effectively.

The second adjusting device 40 comprises the drive motor 41, the threaded shaft 46 rotated by the driving of the drive motor 41, and the moving member 47 screwed to the threaded portion 46*a* of the threaded shaft 46 and fixed to the movable frame 30, and is supported by the main frame 1 and the threaded shaft 46 via the thrust bearing 49 provided therebetween. Thus, a relatively simple instrument configuration can reliably move the movable frame 30 relative to the main frame 1.

The first adjusting device 20 has the shaft body 21 screwed to the main frame 1 and moving the main frame 1, and is supported by the main frame 1 and the movable frame 30 via the thrust bearing 49 provided therebetween. Thus, a relatively simple instrument configuration can reliably move the main frame 1 and the movable frame 30 by the same amount.

Furthermore, the second adjusting device 40 comprises the drive motor 41 having the first gear 43 attached to the output shat 42 and fixed to the first sub-frame 31*a;* the threaded shaft 46 rotated by the driving of the drive motor 41 via the second gear 44 meshing with the first gear 43 provided on the output shaft 42 of the drive motor 41; the moving member 47 screwed to the threaded portion 46*a* of the threaded shaft 46 and fixed to the movable frame 30; and the thrust bearing 49 connected between the main frame 1 and the threaded shaft 46 rotatably and axially immovably. When the first adjusting device 20 moves the main frame 1, the thrust bearing 49, the threaded shaft 46, the moving member 47, and the movable frame 30, the mesh between the first gear 43 and the second gear 44 is not released. Thus, a relatively simple configuration can reliably move the movable frame 30 relative to the main frame 1.

INDUSTRIAL APPLICABILITY

The transport apparatus of the present invention is effective when applied to transporting a sheet, especially, a signature printed by a printing press and folded by a folder.

Reference Signs List

1 Main frame
2 Signature
3 Fan wheel
4*a*, 4*b* Right and left paired belts
5 First transport portion
6*a*, 6*b* Upper and lower paired belts
7 Second transport portion
8 Delivery conveyor
10*a*, 10*b*, 10*c* Right and left paired let-off rollers
11 Chopper table
12 Transport belt
13 Chopper blade
14 Chopper arm
15 First chopper folding device
16 Fixed frame
20 First adjusting device
21 Shaft body
22 Movement restraining member
23 Handle
24 Guide rail
25*a*, 25*b* Right and left paired engaging portions
30 Movable frame
31 Sub-frame
32 Movable frame linear guide
33*a*, 33*b* Slide portion
35 Slot
40 Second adjusting device
41 Drive motor
42 Output Shaft
43 First gear
44 Second gear
45 Bearing
46 Threaded shaft
47 Moving member
48 Connecting pin
49 Thrust bearing
50 Fitting
63, 64 Roller
62, 65 Shaft
66, 72*a* to 72*c* Pressing roller
67, 68*a* to 68*d*, 71*a* to 71*f* Driven roller
73*a*, 73*b* Drive roller
82 Upper support block
84*a*, 84*b* Linear guide
83*a*, 83*b* Lower support block

Citation List

Patent Literature

1. JP-A-2005-145629 (see FIG. 1, etc.)

The invention claimed is:

1. A transport apparatus, including a first transport portion for transporting one sheet, a second transport portion for transporting other sheet, and a fan wheel for entering both of the sheets, which have been transported by the first transport portion and the second transport portion, between vanes of the fan wheel, and rotationally transporting the sheets, the transport apparatus comprising:

a first support member for supporting the first transport portion and the fan wheel;

a second support member for supporting the second transport portion;

first adjusting means for moving the first support member and the second support member by an equal amount; and second adjusting means for moving the second support member relative to the first support member.

2. The transport apparatus according to claim 1, wherein the first adjusting means has a connecting member for connecting the first support member and the second support member together.

3. The transport apparatus according to claim 2, wherein the second adjusting means comprises a drive motor, a threaded shaft rotating upon driving of the drive motor, and a moving member screwed to a threaded portion of the threaded shaft and fixed to the second support member, and the connecting member is a thrust bearing for connecting the first support member and the threaded shaft together so that the threaded shaft is rotatable and axially immovable with respect to the first support member.

4. The transport apparatus according to claim 2, wherein the first adjusting means has a screw screwed to the first support member and moving the first support member.

5. The transport apparatus according to claim 2, wherein the second adjusting means comprises a drive motor having a first gear on an output shaft thereof, a threaded shaft having a second gear meshing with the first gear and rotating upon driving of the drive motor, and a moving member screwed to a threaded portion of the threaded shaft and fixed to the second support member, and when the first support member, the connecting member, the threaded shaft, the moving member, and the second support member are moved by the first adjusting means, mesh between the first gear and the second gear is not released.

6. The transport apparatus according to claim 1, wherein the first adjusting means moves the first support member so that a folding position of the one sheet transported by the first transport portion and folded by a chopper device changes, and also moves the second support member so that a supply position of the other sheet transported by the second transport portion and supplied to the fan wheel does not change according to the movement of the first support member.

7. The transport apparatus according to claim 1, wherein the second adjusting means moves the second support member so that the second transport portion moves between a supply position where the other sheet transported by the second transport portion is supplied to the fan wheel, and a retreat position retreated from the supply position.

8. The transport apparatus according to claim 4, further comprising an operating portion for operating the screw to turn in a forward or reverse direction.

* * * * *